US006085379A

United States Patent [19]

Stafford

[11] Patent Number: 6,085,379

[45] Date of Patent: Jul. 11, 2000

[54] MOUTHBRUSH ADAPTED FOR USE WITH LIQUID CLEANSER PASTE

[76] Inventor: Bryan Wynn Stafford, P.O. Box 6488, Torrance, Calif. 90504

[21] Appl. No.: 09/192,692

[22] Filed: Nov. 16, 1998

[51] Int. Cl.[7] ..... A46B 9/04

[52] U.S. Cl. ..... 15/167.1; 15/205.2; 15/207.2; 132/308; 132/311

[58] Field of Search ..... 15/167.1, 207.2, 15/205.2, 104.94, 160; 428/398; 401/268, 282, 284, 286, 287; 132/308, 311

[56] References Cited

U.S. PATENT DOCUMENTS

| | | | |
|---|---|---|---|
| 800,422 | 9/1905 | White | 15/167.1 |
| 1,711,183 | 4/1929 | Smith | 132/311 |
| 2,303,667 | 12/1942 | Taborski | 15/104.94 |
| 2,888,696 | 6/1959 | Longert | 15/167.1 |
| 4,592,594 | 6/1986 | D'Argembeau | 300/21 |
| 5,836,769 | 11/1998 | Spencer | 433/216 |

*Primary Examiner*—Robert J. Warden, Sr.
*Assistant Examiner*—Kaj K. Olsen
*Attorney, Agent, or Firm*—Monty Koslover

[57] ABSTRACT

A mouthbrush that is particularly adapted for use with liquid cleansers. The construction employs longitudinal grooves in the brush head to store and deliver liquid cleanser paste to hollow bristles that are located below the grooves. These hollow bristles act as additional liquid reservoirs as well as being efficient applicators of a liquid cleanser to the mouth surfaces. The mouthbrush is economical to produce and is competitive with standard available toothbrushes.

2 Claims, 2 Drawing Sheets

Fig 1
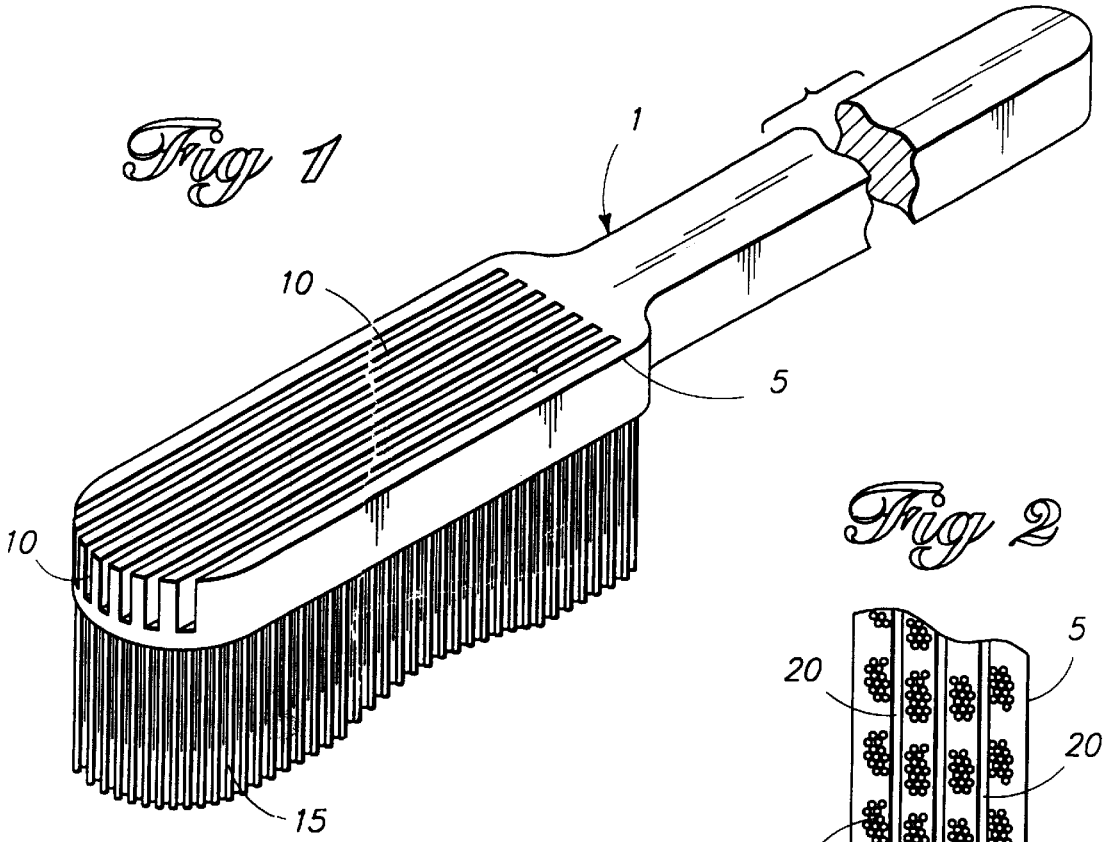
Fig 2
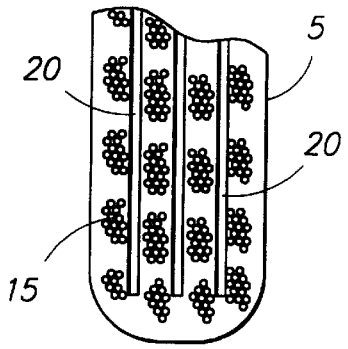
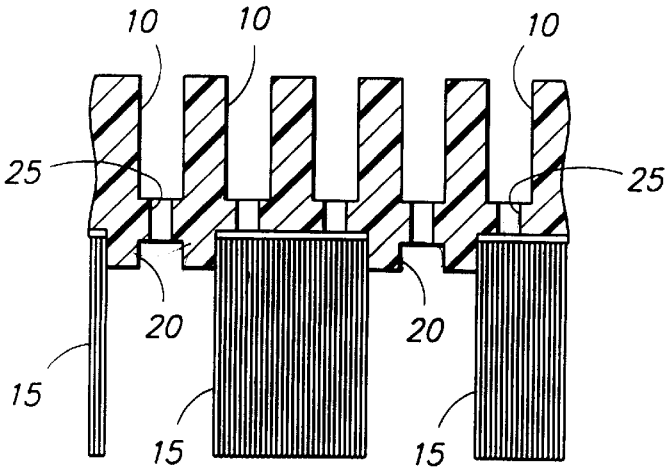
Fig 3

Fig 4
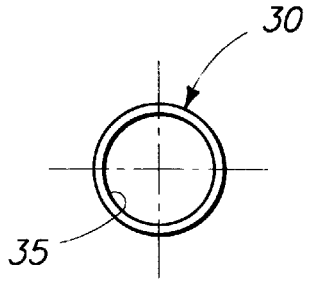
Fig 6
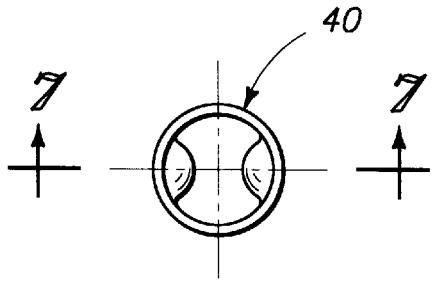
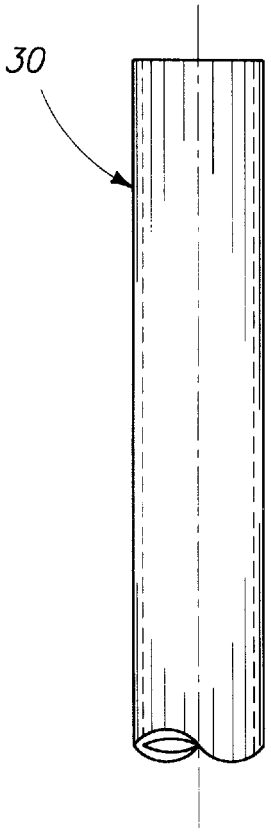
Fig 5
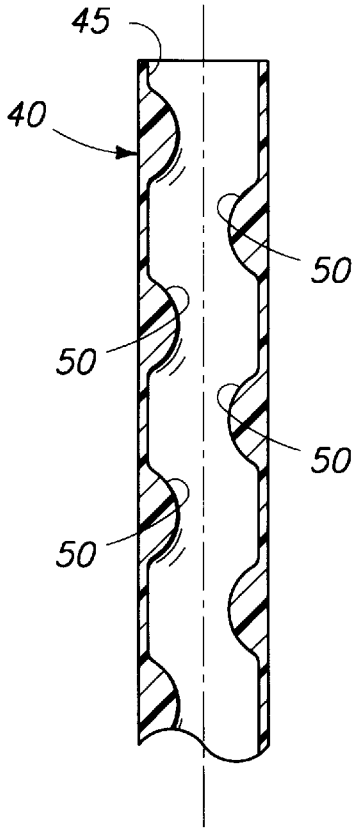
Fig 7

MOUTHBRUSH ADAPTED FOR USE WITH LIQUID CLEANSER PASTE

BACKGROUND OF THE INVENTION

1. Field of the Invention

This invention relates to toiletry devices and particularly to toothbrushes or mouthbrushes.

2. Background

Liquid toothpastes and mouth cleansing fluids have been widely used for many years. Their application to the teeth or mouth generally, is primarily by using a standard type tooth brush which is dipped into a liquid and then applied to the mouth. This approach delivers little fluid to the teeth or other mouth location. However, it has been acceptable since there was no apparent available alternative to a standard mouthbrush.

There exists a number of devices which may contain liquid toothpaste in a brush handle reservoir and provide for pumping the toothpaste into the brush head. Few if any of these devices are currently being offered for sale in the United States. They therefore, do not influence a perceived need for a more efficient way of delivering liquid toothpaste or cleanser to the mouth than is presently available.

SUMMARY OF THE INVENTION

The invention is a mouthbrush that employs longitudinal grooves in the brush head to deliver liquid cleanser paste to hollow bristles that are located below the grooves. The hollow bristles act as additional liquid reservoirs as well as being efficient applicators of a liquid cleanser to the mouth surfaces.

Accordingly, it is a principal object of this invention to provide a mouthbrush that will deliver liquid toothpaste or other mouth cleansing fluid efficiently to surfaces in the mouth.

An advantage of the invention over other devices that include liquid reservoirs, is its relatively low cost.

Further objects and advantages of the invention will be apparent from studying the following portion of the specification, the claims and the attached drawings.

BRIEF DESCRIPTION OF THE DRAWINGS

FIG. 1 is a partial perspective view of the present invention mouthbrush, particularly showing deep longitudinal grooves in the top surface head of the mouthbrush above bristles;

FIG. 2 is a partial plan view of the underneath of the mouthbrush head, particularly showing longitudinal grooves in the surface and their relationship to clumps of bristles;

FIG. 3 is a partial cross-section of the head of the mouth brush, taken at a right angle to the longitudinal grooves, and showing how the top grooves communicate fluid to the bristles;

FIGS. 4 and 5 are respectively, an end view and a partial side view of a simple hollow bristle for internal liquid retention and flow;

FIG. 6 is an end view of an alternate modified flow, hollow bristle that includes raised projections which are offset inside the bristle to slow liquid flow; and FIG. 7 is a partial cross-section view taken along line 7—7 of FIG. 6.

DESCRIPTION OF THE PREFERRED EMBODIMENT

Referring particularly to the drawings, there is shown in FIG. 1 a partial perspective view of a liquid cleanser mouthbrush 1 according to the present invention.

The mouthbrush 1 is designed to be dipped into a container of liquid toothpaste or other liquid mouth cleanser, and to provide reservoirs in the brush head 5 that will hold sufficient liquid from the dip for a thorough mouth cleaning.

Referring to FIGS. 1, 2 and 3, a plurality of deep, longitudinal grooves 10 are formed in the top surface of the brush head 5, and a number of shallow, longitudinal grooves 20 are formed in the bottom surface of the brush head. These grooves 10, 20 are relatively narrow in width, and therefore will retain a significant amount of liquid therein after dipping, due to capillary action. The retained liquid in the brush top surface grooves 10 communicates with the tops of clumps of embedded hollow bristles 15 by passing through slots 25 cut in the bottom of the grooves as shown in FIG. 3 and into the cavities of the hollow bristles.

The hollow bristles 15 will pass the liquid obtained from the brush head grooves, slowly through and into a user's mouth until no more liquid is available.

Some of the head top grooves 10 also supply bottom grooves 20 with liquid, which adds to the amount retained in the bottom grooves immediately after a dip in a liquid container. The bottom grooves 20 supply liquid directly to the mouth for brushing with the bristles. Thus, the brush design enables a metered amount of liquid cleanser to be applied to a mouth, enhancing efficiency of application.

Referring to FIGS. 4, 5, 6 and 7, there are two alternative approaches offered herein for a practical, hollow bristle for use as part of the invention mouthbrush. These are: a simple, hollow bristle 30, and a modified flow, hollow bristle 40. The simple hollow bristle 30 is tubular and has a straight surfaced internal cavity and a thin wall 35. The bristle cavity diameter is small in size, which allows fluid to pass through under normal usage, but rather slowly. This is considered to be desirable for most uses such as brushing teeth.

The modified flow bristle 40 illustrated in FIGS. 6 and 7, on the other hand includes a number of offset, raised projections 50 located inside the bristle and along its length. Although the bristle wall 45 is thin, these wall projections 50 act to restrict flow of the liquid inside the bristle. This results in a slower liquid flow than that obtained using the simple hollow bristle 30, and for some mouth applications such as brushing the back of the tongue, it is more desirable.

The bristles 15 are grouped in clumps and arranged embedded in the underside of the mouthbrush head 5. They may be all of one of the alternate bristle configurations or they can be mixed.

The mouthbrush 1 can be produced with any handle shape and variations in the head shape, so long as there is enough space allowed for the required top and bottom grooves in the brush head. It is economical to produce and can be offered for sale at prices competitive with presently available tooth brushes. As such, it is believed that this invention mouthbrush will be welcomed by users of liquid toothpaste and liquid mouth cleaners.

From the foregoing description, it is clear that the described embodiments achieve the objects of the present invention. Various modifications and alternatives may be apparent to those skilled in the art. These modifications and alternatives are considered to be within the spirit and scope of the present invention.

Having described the invention, what is claimed is:

1. A mouthbrush comprising a brush head portion connected to a handle portion defining a longitudinal axis, and a multiplicity of tubular hollow bristles;

said brush head portion having a planar top surface and a planar bottom surface parallel with said top surface, said top surface including a plurality of deep, paralleled longitudinal top grooves cut and sized in width to enhance temporary liquid retention, said top grooves including slots cut in the bottom of the top grooves through the thickness of said head portion and communicating with said bottom surface;

said bristles are arranged in longitudinal rows having their top portions embedded in said bottom surface and placed so that bristle end openings communicate with said slots and can receive liquid that may be passing through said slots from said top grooves;

said bottom surface including a plurality of shallow, paralleled longitudinal bottom grooves cut and sized in width to enhance temporary liquid retention; said bottom grooves being located between rows of bristle groups and communicating with said top grooves through said slots in said top grooves; said hollow bristles and said bottom grooves, after said brush head has been dipped in fluid, dispensing stored fluid slowly into and against a user's mouth surfaces.

2. A mouthbrush according to claim 1, wherein said hollow bristles include inside wall projections which are arranged offset from each other along the bristle length so as to produce a narrowed, serpentine liquid flow path; said projections acting to slow the exit of any fluid entering or retained by said bristles.

* * * * *